US006634500B2

(12) United States Patent
McKinney

(10) Patent No.: US 6,634,500 B2
(45) Date of Patent: Oct. 21, 2003

(54) LUG NUT STORAGE DEVICE

(75) Inventor: Jeffrey D. McKinney, Kannapolis, NC (US)

(73) Assignee: Jeffrey D. McKinney, The Wiz, Kannapolis, NC (US)

( * ) Notice: Subject to any disclaimer, the term of this patent is extended or adjusted under 35 U.S.C. 154(b) by 0 days.

(21) Appl. No.: 10/039,408

(22) Filed: Oct. 29, 2001

(65) Prior Publication Data

US 2003/0080009 A1 May 1, 2003

(51) Int. Cl.[7] ..... B65D 85/20
(52) U.S. Cl. ..... 206/378; 206/493; 211/70.6
(58) Field of Search ..... 206/378, 493, 206/478, 482, 483, 372, 373, 349; 211/70.6

(56) References Cited

U.S. PATENT DOCUMENTS

| | | | | | |
|---|---|---|---|---|---|
| 3,829,183 | A | | 8/1974 | Hans | |
| 5,452,944 | A | | 9/1995 | Bear | |
| 5,467,874 | A | * | 11/1995 | Whitaker | 206/378 |
| 5,640,889 | A | * | 6/1997 | Anderson | 81/125 |
| 5,827,487 | A | * | 10/1998 | Holmes | 422/297 |
| 6,070,745 | A | * | 6/2000 | Dembicks | 211/70.6 |

* cited by examiner

*Primary Examiner*—Shian Luong

(57) ABSTRACT

A storage assembly for lug nuts with two cylindrical rubber projections having concave sides with a top raised ridge and lower bottom support, said cylindrical rubber projections having an internal female insert in which a male stud assembly with a rubber coated cylindrical bottom is inserted after passing through a flexible plastic base located between said male stud assembly and said cylindrical rubber projections.

5 Claims, 5 Drawing Sheets

LUG NUT STORAGE DEVICE

BACKGROUND—FIELD OF INVENTION

This invention relates to the use and storage of lug nuts when used to change a tire during a pit stop in a professional sports-car race. When a racecar exits the track to have a tire changed during the race, a specialized team of experts perform various assigned duties to facilitate the tire change. The most important task is to remove the old tire and then quickly and safely secure the replacement tire, with new lug nuts, in the least amount of time.

DESCRIPTION OF INVENTION

My invention provides a safe, quick and economical solution to this problem. It is a storage device which is attached to the top of a glove approximately halfway between the bottom of the finger joints and the wrist. Specifically, it has two raised rubber cylinders arranged horizontally across the surface of the glove. They are equidistantly spaced to provide symmetrical balance to the device. A flexible foundation base allows the rubber cylinders to arc with the natural curvature of the hand thus facilitating ease of use and application.

BACKGROUND—DESCRIPTION OF PRIOR ART

Heretofore different arrangements have been used to quickly adhere lug nuts to a vehicle wheel. One such arrangement is U.S. Pat. No. 3,829,163, Hans., 1974. Hans teaches a wheel assembly which uses glue to premount lug nuts to a replacement wheel. This allows a fairly quick replacement of the old wheel and lug nuts. This is a good method, however, the glue used to mount the lug nuts can break down at high temperatures. Additionally, the entire wheel has to be replaced. My invention allows the user to quickly replace just one, or more, lug nut without taking of the existing wheel.

A different arrangement is used by U.S. Pat. No. 5,452, 944, Bear, 1995. This device is composed of a stretchable foam material which has lug nut contained thereon which can be detached when needed. The lug nuts are attached to the wheel with an adhesive. Although this allows one lug nut at a time to be attached, it is very cumbersome and awkward. When pulled too hard many lug nuts can fall off and drop on the ground. The result is lost lug nuts which can be a safety hazard if stepped upon and not enough lug nuts if multiple units are needed. Additionally, there is no place to carry the device except buried deep in your pocket or hanging it from your belt. It can get tangled and snagged with many other things. However, my invention is a revolutionary and unique innovation. It conveniently rests upon the back of the hand for easy access and quick efficient replacement of lug nuts.

OBJECTS AND ADVANTAGES

Accordingly, several objects and advantages of my invention are to provide a safe, easy and quick method to change lug nuts during a pit stop. The action along pit road is furious. Racing officials monitor all pit stops to check compliance with current rules and regulations. One important rule is that all wheels must have all five lug nuts on and tight. If one is missing, the driver can not leave until it is replaced. If he does leave without replacing the missing lug nut, the official will make him come in for an additional pit stop to correct this problem. This costs the driver valuable time resulting in loss of track position and consequently purse money, points and the victory of the race.

Currently, the tire change technicians carry extra lug nuts in their pockets or on a thin rubber cord which hangs from their belt. This cord constantly gets snagged around other tools, or upon objects the technician comes in contact with, and the lug nuts either fall off by mistake or get tangled and are difficult to remove. During a pit stop, every second is important. One second can make the difference between a victory and placing far back in the field.

My invention solves the persistent problem of immediately having a lug nut readily available when it is needed. Instead of fumbling around in your pocket or on your belt loop for a lug nut, you have instant access to it. By placing the lug nut storage device on your glove, the lug nut can be easily removed. The hand reaching for it does not become snagged inside a pocket or tangled in a heavy utility belt with many things hanging off of it. The technician does not even have to stand upright to search through his pockets. He can remain in the squatting position and simply remove one from the top of his glove. Not only does this save valuable time but dramatically reduces accidents resulting from the technician having to stand up and awkwardly move around to find a lug nut. There are numerous technicians, each assigned a specific task, simultaneously working upon a car during a pit stop. Each has a tiny space to work within and can not interfere with his fellow technician's workspace. It they bump into each other during the frenzied pit stop, it could result in their death. It is imperative they maintain the utmost precision and exactness during their task. Another advantage is that the technician can visually see whether he has spare lug nuts on his glove. This prevents him from being caught without one when he must have a lug nut to replace a missing one. If they were in his pocket or on his belt, he could not make this quick status check.

Not only does my invention allow the lug nuts to be in a more convenient and accessible position, it keeps them more secure. This prevents loss of the lug nuts and easier handling. The rubber cylinders, they are attached to, have concave sides to provide a snug fit. The top of the cylinders has a flared holding ridge to act as a top lip and prevent them from coming off the top. This allows the lug nuts to come into contact with other objects and surfaces without detaching. They must be removed by curling the fingers around the circumference of the lug nut and pulling upward. The natural curve of the flared ridge is designed to match the curvature of the human finger when it is bent inward towards the palm of the hand during the removal process. The bottom of the cylinder has a flat base which keeps the cylinder perfectly aligned with a flexible foundation base. This base has been designed to provide support for the many divergent vertical stress vectors created by the weight of the lug nuts.

The base easily curves to any arc the top of the hand can assume. This maintains the vertical integrity of the rubber cylinders and prevents the lug nuts from pulling vertically in opposite directions. The result is a perfect balance of the lug nuts upon the top of the hand. Because the cylinders are attached to the glove with a male-female threading system, they can be immediately replaced if a cylinder becomes damaged. The male threading assembly has a safety rubber backing to prevent the irritation of the skin beneath the glove.

PREFERRED EMBODIMENT—DESCRIPTION

Figure 1:
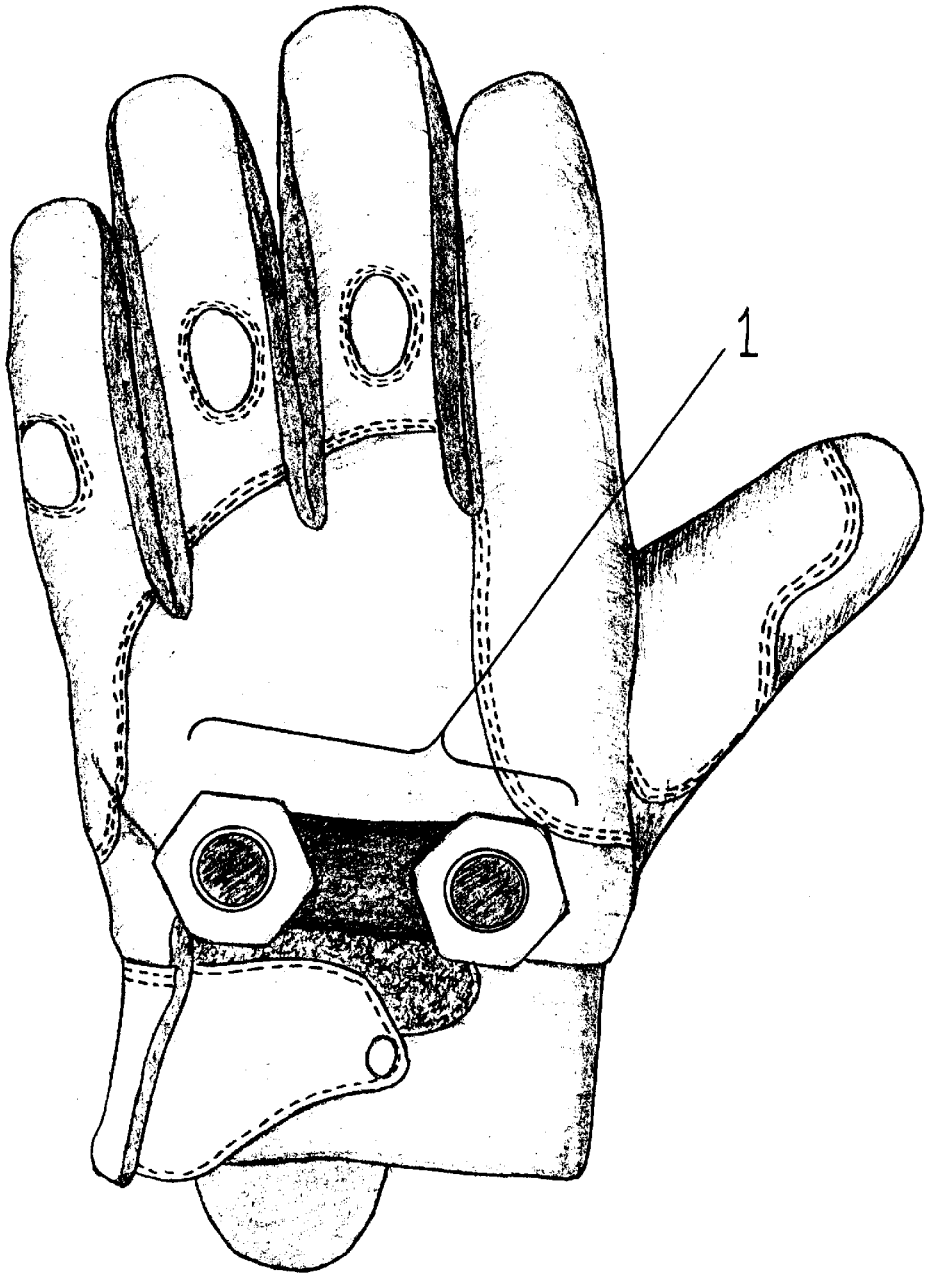
FIG. 1 is view of the device mounted upon a glove.
Figure 2:
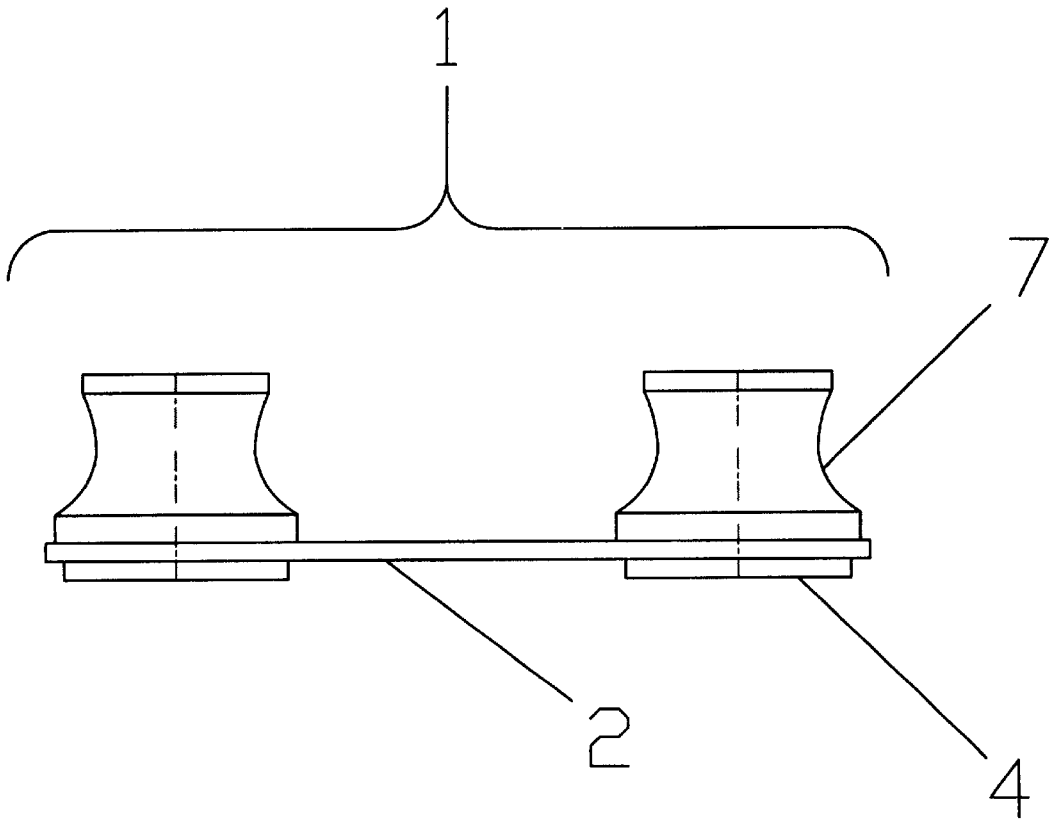
FIG. 2 is a lateral view of the mounted device without the glove.
Figure 3:
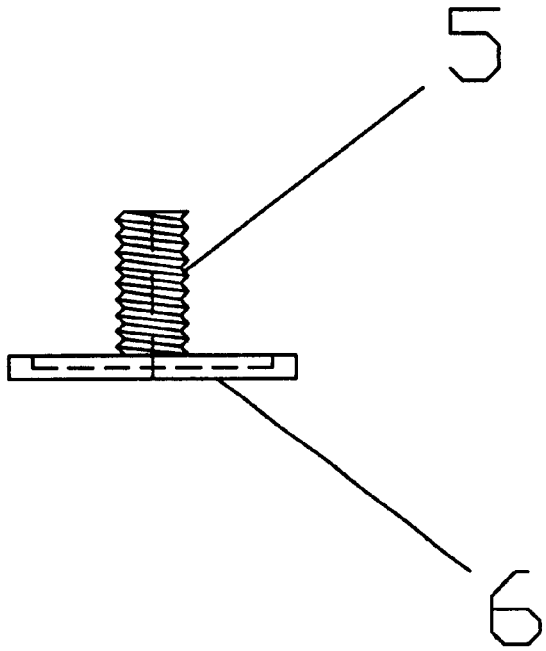
FIG. 3 is a lateral view of the male stud and rubber protective backing.
Figure 4:
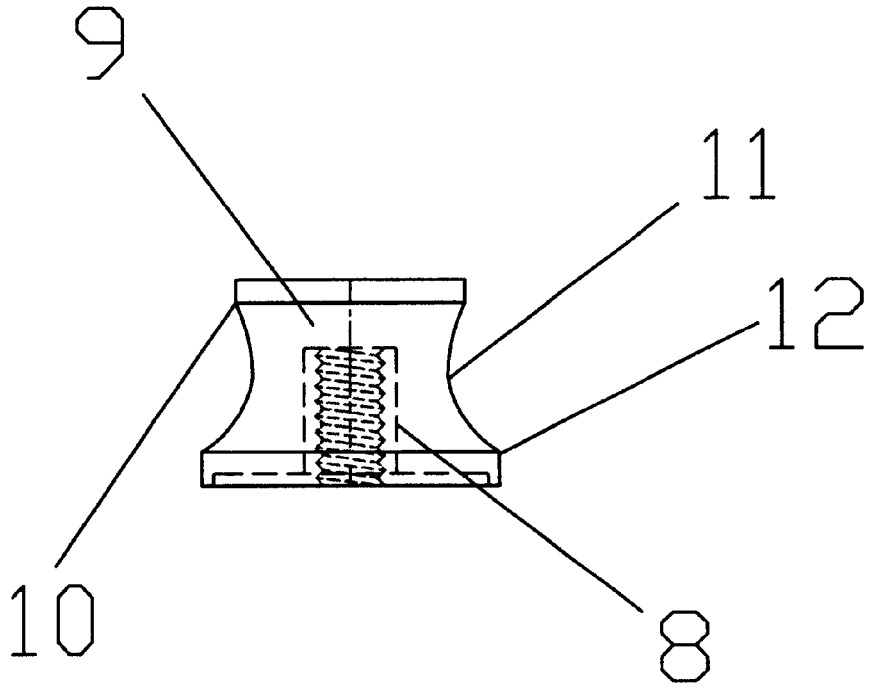
FIG. 4 is a lateral view of an entire rubber cylinder with a cut-away view of the inside of the cylinder.
Figure 5:
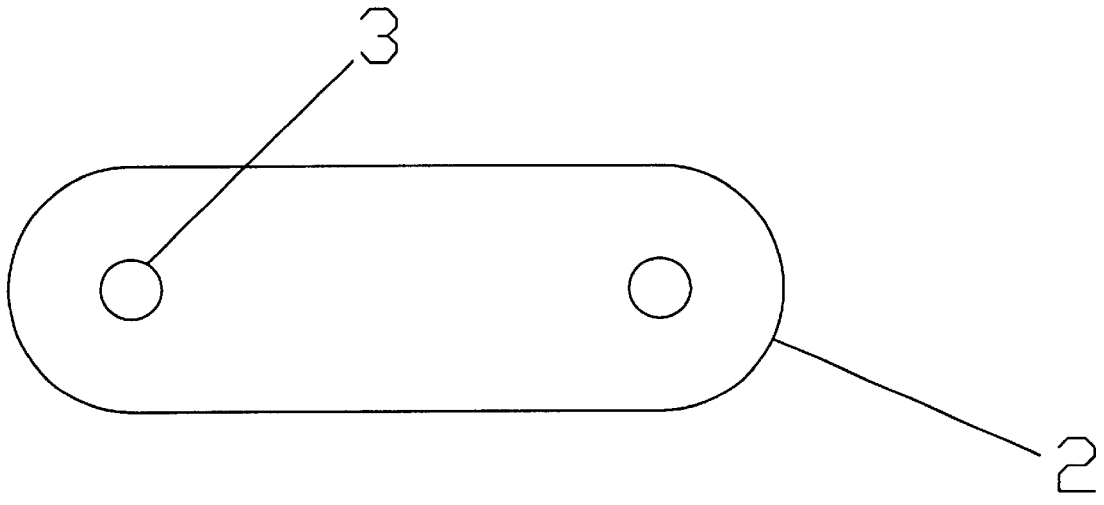
FIG. 5 is a top view of the flexible foundation base.

Operation and use of the undergarment is simple and straightforward. FIG. 1 depicts the entire unit, 1, mounted upon a glove. In FIG. 2, the lug nut projection assembly, 7, is adhered to the flexible foundation base, 2, by screwing it onto the male stud assembly, 4. The male stud assembly, 4, enters through the bottom of the flexible foundation base, 2. FIG. 3, shows the male round head stud, 5, and a rubber protective backing, 6, attached to the base of the male round head stud, 5. In FIG. 4, the lug nut projection assembly, 7, has a female insert, 8, which screws onto the male round head stud, 5. The rubber projection, 9, has a top holding ridge, 10, and concave taper, 11, which work in unison to provide a tight secure fit for the lug nut. The lower bottom support, 12, provides a level flush-fitting bottom to keep the rubber projection, 9, in a upright position. In FIG. 5, the flexible foundation base, 2, has two holes, 3, to accommodate the insertion of the male stud assembly, 4, from beneath the flexible foundation base, 2, into the female insert, 8, located inside the lug nut projection assembly, 7.

Conclusions, Ramifications and Scope

My invention provides a safe, quick and secure method to store lug nuts until they are needed to facilitate a tire change during a pit stop. It is adhered to a glove and located equidistantly between the bottom of the knuckles and the wrist region. It has two cylindrical rubber projections which accommodate the lug nuts.

Although the description above contains many specificities, these should not be construed as limiting the scope of the invention but a merely providing illustrations of some of the presently preferred embodiments of this invention. Various other embodiments and ramifications are possible with it's scope.

Thus the scope of the invention should be determined by the appended claims and their legal equivalents, rather than by the examples given.

What is claimed is:

1. A storage assembly for lug nuts having two cylindrical rubber projections with concave sides and a top raised ridge and bottom support, said cylindrical rubber projections having an internal female insert in which a male stud assembly with a rubber coated cylindrical bottom is inserted.

a flexible plastic base located between said male stud assembly and said cylindrical rubber projections.

2. The combination defined in claim 1 wherein said base and said projections are composed of a magnetic composition.

3. The combination defined in claim 1 wherein said base and said projections are composed of aluminum.

4. The combination defined in claim 1 wherein said base and said projections are composed of leather.

5. The combination defined in claim 1 wherein said projections are threaded.

* * * * *